US005373677A

United States Patent [19]

Vagedes

[11] Patent Number: 5,373,677

[45] Date of Patent: Dec. 20, 1994

[54] SHUTTER ASSEMBLY WITH GROOVED EDGE

[75] Inventor: Michael Vagedes, Florence, Ky.

[73] Assignee: Richwood Building Products, INc., Richwood, Ky.

[21] Appl. No.: 261,733

[22] Filed: Jun. 17, 1994

Related U.S. Application Data

[63] Continuation-in-part of Ser. No. 60,316, May 11, 1993, Pat. No. 5,347,782.

[51] Int. Cl.[5] ..... E06B 7/08

[52] U.S. Cl. ..... 52/473; 52/823; 403/363

[58] Field of Search ..... 52/822, 823, 827, 829, 52/473, 455; 403/363, 375

[56] References Cited

U.S. PATENT DOCUMENTS

| | | | |
|---|---|---|---|
| Re. 18,077 | 5/1931 | Larson . | |
| 3,055,467 | 9/1962 | Peek et al. | 52/473 X |
| 3,191,242 | 6/1965 | Rauen . | |
| 3,394,518 | 7/1968 | Worrell, Jr. . | |
| 3,455,079 | 7/1969 | Frederick . | |
| 3,527,486 | 9/1970 | Gamp . | |
| 3,797,186 | 3/1974 | Smith . | |
| 3,968,738 | 7/1976 | Matzke . | |
| 4,193,245 | 3/1980 | Johnson | 52/455 X |
| 4,251,966 | 2/1981 | Foltman . | |
| 4,381,633 | 5/1983 | MacLeod | 52/473 |
| 4,765,110 | 8/1988 | MacLeod . | |
| 4,858,400 | 8/1989 | Foyt . | |
| 5,060,442 | 10/1991 | Chubb . | |
| 5,152,116 | 10/1992 | MacGowen . | |

FOREIGN PATENT DOCUMENTS

| | | | |
|---|---|---|---|
| 2241684 | 3/1975 | France | 52/473 |

*Primary Examiner*—Jerry Redman
*Attorney, Agent, or Firm*—Wood, Herron & Evans

[57] ABSTRACT

A shutter assembly is provided which includes a body portion and separate top and bottom caps. The length of the shutter is adjusted by sliding the caps so they cover more or less of the shutter body. The caps and body portion are then screwed to a building wall. The inside surfaces of the caps include grooves which mate with the outside surface of the sides of the shutter body. This keeps the caps aligned with the shutter body as the length is adjusted.

4 Claims, 2 Drawing Sheets

SHUTTER ASSEMBLY WITH GROOVED EDGE

This is a continuation in part of application Ser. No. 08/060,316, now U.S. Pat. No. 5,347,782, filed May 11, 1993, entitled Shutter Assembly.

BACKGROUND OF THE INVENTION

Most shutters which are now used with homes serve only an ornamental function. As such, most of these are formed by injection molding using colored plastic to permit formation of a plastic shutter which does not rot and generally does not require painting. Distributors simply stock shutters of different colors so that he can supply them to their customers.

In addition to a variety of a number of different colors, there are also a number of different sizes. Windows come in many different lengths and as such the shutter must correspond in size to the length of the window. Thus, the distributor must not only stock different colors but must stock different sizes, frequently ten to fifteen different sizes. The problem created by this is quite obvious. The stocking requirements are prohibitive for many distributors.

To overcome this problem, plastic shutters have been formed which can be adjusted in size. Several of these are disclosed in U.S. Pat. Nos. 5,152,116, 4,765,110, 3,455,079 and 4,251,966.

The problem with each of these designs is that the adjustment is too complex. Generally, the adjustment must be made by the distributor as opposed to the end user due to the complexity of the adjustment. Precise cuts are required plus assembly using various fasteners, plastic rivets and the like. This is totally unacceptable if one wishes to adjust the size of the shutter at the job site. Further, due to the large number of separate components, these shutters rattle and can easily fall apart.

SUMMARY OF THE INVENTION

Accordingly, it is an object of the present invention to provide a shutter which can be shortened easily and simply, permitting adjustment at the job site.

It is also an object of the present invention to provide such a shutter which can be lengthened or shortened easily, and quickly assembled and installed.

The objects and advantages of the present invention are obtained by providing a shutter which has a body portion without a fixed top and/or bottom end cap. The body portion is one molded piece including the stiles, mullion and slats. The ends of the shutter are covered with preformed end caps. The shutter is assembled by screwing through the end cap and through the body portion into the house, assembling the shutter and attaching it to the house at the same time.

The end cap can slide up or down the body portion providing up to about four inches of adjustment without cutting the body portion. Each end cap includes a front and two sides. The inside surface of the sides include 2 vertical ridges which mate with complementary grooves on the outside surfaces of the sides of the body portion. This maintains the caps in alignment as they are fixed to the building wall.

The objects and advantages of the present invention will be further appreciated in light of the following detailed description and drawings in which:

DETAILED DESCRIPTION

Figure 1:
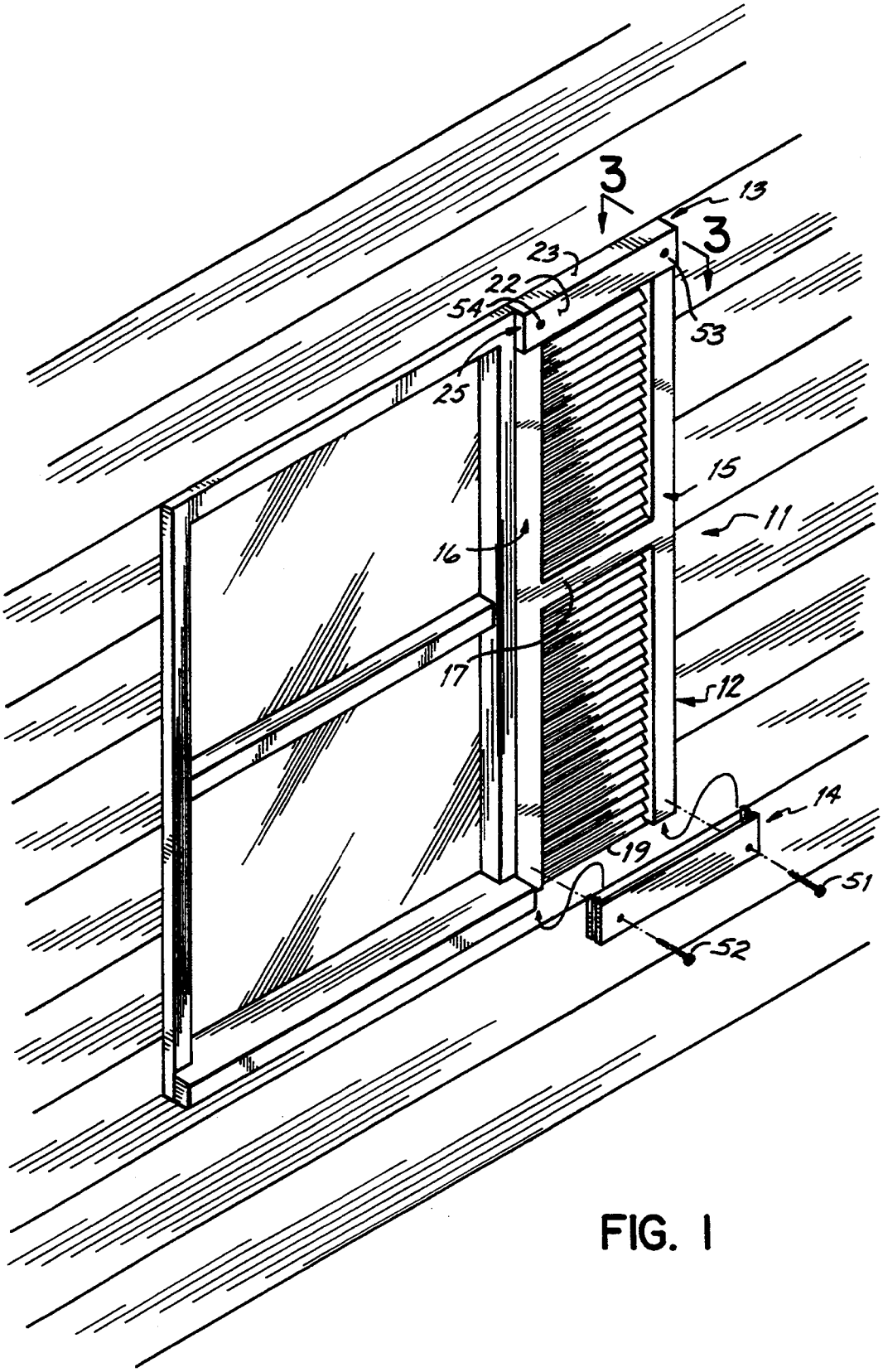
FIG. 1 is a perspective view of an assembled shutter as attached to a building.
Figure 2:
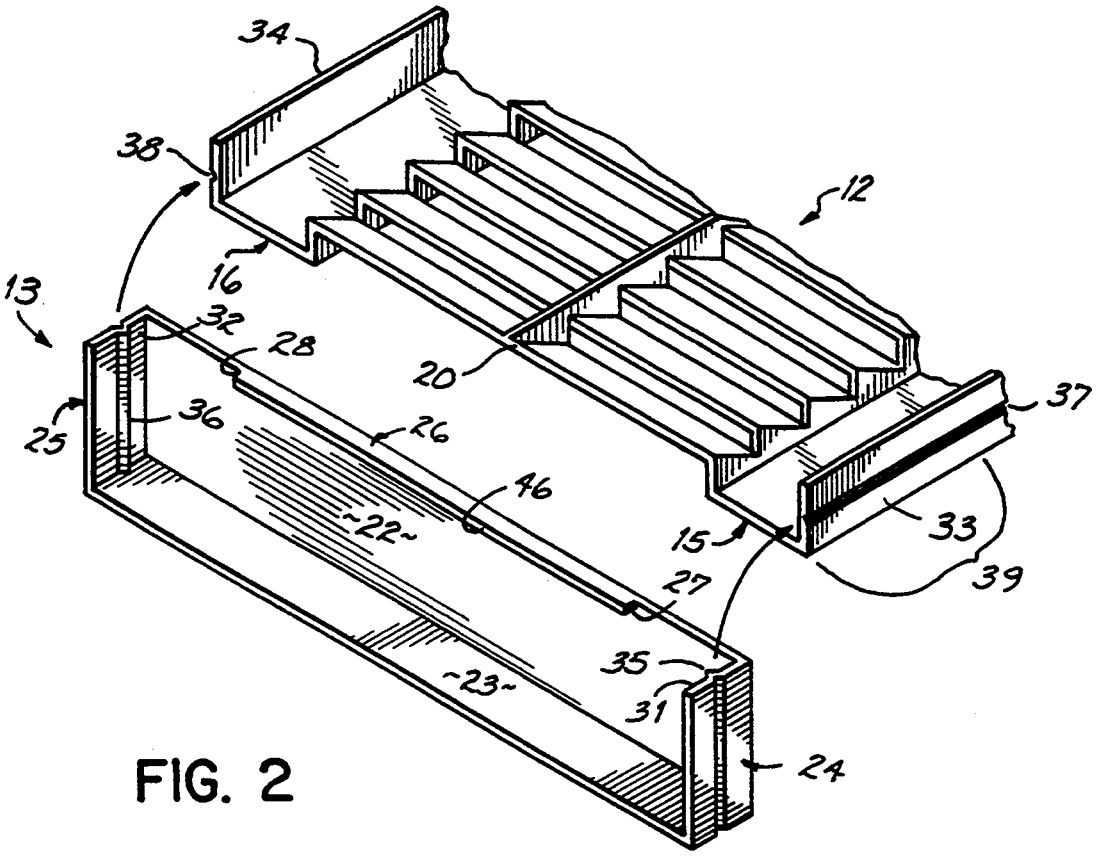
FIG. 2 is a perspective view showing the placement of an end cap over the shutter body.
Figure 3:
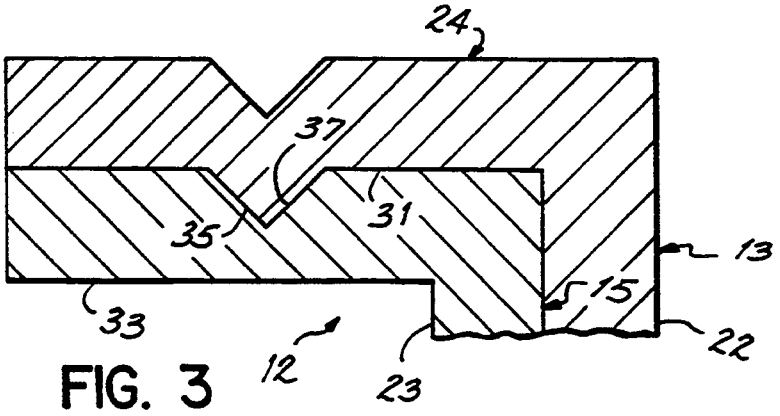
FIG. 3 is a cross-sectional view taken along lines 3—3 of FIG. 1.

The present invention is a plastic shutter assembly 11 preferably injection molded from, for example, polypropylene. As shown in FIG. 1, shutter assembly 11 includes a body portion 12, a top cap 13 and a bottom cap 14. The body portion 12 is formed as with most shutters having a right stile 15 and a left stile 16 parallel to each other. Separating the right stile 15 from the left stile 16 is a central mullion or panel 17. The body portion 12 also includes two distal ends 19 and 20.

Except as noted, bottom cap 14 and top cap 13 are the same and only cap 13 is described in detail Bottom cap 14 includes a front panel 22 which has a horizontal endwall 23 and a first vertical sidewall 24 and a second vertical sidewall 25. Opposite the horizontal endwall 23 is a horizontal lip 26. The lip 26 does not extend all the way to the first and second vertical walls 24 and 25, but runs short stopping at edges 27 and 28. The distance from edges 27 and 28 to side walls 24 and 25 corresponds in size to the outer width of stiles 15 and 16 respectively.

The inside surfaces 31 and 32 of sides 24 and 25 have a surface which mates with the outside surfaces 33 and 34 of stiles 15 and 16. These mating surfaces can have a variety of different grooves and ridges which maintain the two properly aligned. As shown in the Figures, inside surfaces 31 and 32 include vertical ridges 35 and 36 which have a triangular cross section. Outside surfaces 33 and 34 of stiles 15 and 16 include vertical grooves 37 and 38 which mate with ridges 35 and 36. These mating surfaces keep the end caps 13 and 14 properly aligned and attached to the shutter body 12 and permit them to slide vertically until permanently attached.

The front panel 22 of cap 13 is at least about 1 inch long (as measured from lip 26 to end wall 23) and preferably 2 to 3 inches long. This provides sufficient area to cover the bottom portion 39 of the shutter body 12 as discussed below and to provide an area for screws to permit assembly of the shutter.

As previously discussed, the invention provides the means to adjust the length of the shutters so that they can be used for a variety of different windows. End caps which are three inches long can cover the top and bottom three inches of the shutter or they can cover as little as one inch. Thus, by sliding the top and bottom caps, the length of the shutter can be adjusted up to four inches. If desired, the top and/or bottom of the body portion 12 can be cut to shorten the overall length.

The lip 26 has a width so that when the stiles rest against the inside surface of the cap, its inside edge 46 will be very close (about ⅛ inch) from the slats.

The shutter 11 is attached to the side of the house wall by screwing through the panel 22 through left and right stiles 15 and 16 and into the wall. This will be done with both the top and bottom caps so that four screws 51, 52, 53 and 54 are fastened through the caps 13 and 14 and stiles and into the wall holding the shutter assembly together and fastened to the building wall as shown.

Caps 13 and 14 may include preformed holes (not shown) through panel 22 to assist in assembly. With the caps 13 and 14 on the body portion 12, holes can be drilled through the stiles using the preformed holes in the caps 13 and 14 as guides. The ridges 35 and 36 sliding within grooves 37 and 38 provide stability to the assembled shutter making sure that caps are properly aligned with the shutter body.

It may be preferred to have only a top cap and have the bottom cap a molded part of the body portion. This would limit the size adjustment, but would be less expensive.

The present invention can, of course, be used if the slats are replaced with a raised panel. Only the contour of edge 26 would have to be modified. Further, the present invention would permit the vertical ridge to be formed on side 33 and 34 with mating vertical grooves on inside surfaces 31 and 32. Further, multiple mating grooves can be employed if desired. Of course, the triangular grooves and ridges shown in the drawings can be replaced with grooves and ridges having other cross-sections as long as they generally mate and keep the cap aligned with the shutter body.

This has been a description of the present invention along with the preferred method of practicing the present invention. However, the present invention should be defined only by the appended claims wherein I claim:

1. A shutter assembly comprising a body portion and cap;

said body portion having first and second distal portions and two parallel lateral stiles, said first distal portion having a front surface and an upper edge and two lateral sides;

said cap having two side walls adapted to slide along said two lateral sides of said first distal portion;

wherein said cap is fitted over said first distal portion; said cap covering said upper edge, said lateral sides and said front surface of said first distal portion and thereby permitting the length of said shutter to be adjusted by covering a selected length of said front portion;

wherein said lateral sides of said first distal portion and said two side walls of said cap have complementary vertical grooves and ridges adapted to maintain said cap in position on said first distal portion and permits said cap to slide relative to said first distal portion.

2. The shutter assembly claimed in claim 1 further including a lower cap adapted to cover said second distal portion wherein said second distal portion and said second cap include complementary vertical ridges and grooves adapted to permit said cap to slide relative to said second distal portion.

3. The shutter assembly claimed in claim 1 wherein said two side walls of said end cap have vertical ridges which mate with vertical grooves in said lateral sides of said first distal portion.

4. The shutter assembly comprising a body portion, an upper cap and a lower cap;

said body portion having a first and a second distal portion and two parallel lateral stiles, each of said distal portions having a distal edge and two lateral sides;

wherein said side walls of each of said end caps include vertical ridges and wherein said lateral sides include vertical grooves and wherein said ridges mate with said grooves, keeping said end caps aligned over said distal portions;

each of said caps having two side walls adapted to slide along said lateral sides of said distal portions.

* * * * *